US012369654B2

(12) United States Patent
Gasser

(10) Patent No.: US 12,369,654 B2
(45) Date of Patent: Jul. 29, 2025

(54) ARTICLE OF CLOTHING INTEGRATING AT LEAST TWO INTERCONNECTED CONDUCTIVE WIRES AND CORRESPONDING INTERCONNECTING METHOD

(71) Applicant: SARL SP, Voiron (FR)

(72) Inventor: Jèrôme Gasser, Villeurbanne (FR)

(73) Assignee: SARL SP, Voiron (FR)

( * ) Notice: Subject to any disclaimer, the term of this patent is extended or adjusted under 35 U.S.C. 154(b) by 1042 days.

(21) Appl. No.: 17/424,523

(22) PCT Filed: Jan. 20, 2020

(86) PCT No.: PCT/FR2020/050071
§ 371 (c)(1),
(2) Date: Jul. 21, 2021

(87) PCT Pub. No.: WO2020/152413
PCT Pub. Date: Jul. 30, 2020

(65) Prior Publication Data

US 2022/0061413 A1 Mar. 3, 2022

(30) Foreign Application Priority Data

Jan. 22, 2019 (FR) ..... 1900559

(51) Int. Cl.
*A41D 1/00* (2018.01)
*A41D 13/005* (2006.01)
*A41D 13/12* (2006.01)

(52) U.S. Cl.
CPC ..... *A41D 1/005* (2013.01); *A41D 13/0051* (2013.01); *A41D 13/1281* (2013.01); *A41D 2400/10* (2013.01)

(58) Field of Classification Search
CPC ..... A41D 1/005; A41D 13/0051; A41D 13/1281; A41D 2400/10; H05B 6/36; H05B 6/362; H05B 6/44
(Continued)

(56) References Cited

U.S. PATENT DOCUMENTS 2,107,598 A * 2/1938 Colvin, Jr. ..... H05B 3/342 219/545
3,751,620 A * 8/1973 Yuasa ..... H05B 3/342 338/211
(Continued)

FOREIGN PATENT DOCUMENTS

EP 0128103 A1 12/1984
EP 1506738 A1 2/2005
(Continued)

OTHER PUBLICATIONS

International Search Report for Corresponding International Application No. PCT/FR2020/050071, date of mailing Apr. 17, 2020 (9 pages).

*Primary Examiner* — Elizabeth M Kerr
*Assistant Examiner* — Simpson A Chen
(74) *Attorney, Agent, or Firm* — Harris Beach Murtha Cullina PLLC

(57) ABSTRACT

The invention concerns an article of clothing (10) comprising at least two conductive wires capable of transmitting an electric current, at least one conductive wire being integrated into at least one flat seam (12*a*); and at least one electrical interconnection between the at least two conductive wires; the electrical interconnection incorporating a weld (25) between the at least two conductive wires; the electrical interconnection is protected by two layers of fabric (21-23) attached respectively above and below the electrical interconnection; a lower layer of fabric (22) bonded to the article of clothing (10) above which the at least two conductive
(Continued)

wires extend; and an upper layer of fabric (23) bonded to the lower layer of fabric (22) so as to form, with the lower layer of fabric (22), a protective barrier around the electrical interconnection.

10 Claims, 6 Drawing Sheets

(58) Field of Classification Search
USPC ..... 219/202, 211
See application file for complete search history.

(56) References Cited

U.S. PATENT DOCUMENTS

| | | | | |
|---|---|---|---|---|
| 2010/0258334 | A1* | 10/2010 | Akaike | H05K 1/038 174/126.1 |
| 2014/0180624 | A1* | 6/2014 | Nikonov | G01K 1/14 29/601 |

FOREIGN PATENT DOCUMENTS

| | | | |
|---|---|---|---|
| JP | 2009228161 | | 10/2009 |
| WO | WO-2017013493 | A1 | 1/2017 |
| WO | WO-2017031153 | A1 | 2/2017 |

* cited by examiner

ARTICLE OF CLOTHING INTEGRATING AT LEAST TWO INTERCONNECTED CONDUCTIVE WIRES AND CORRESPONDING INTERCONNECTING METHOD

CROSS-REFERENCE TO RELATED APPLICATIONS

This application is a national stage application under 35 U.S.C. § 371 of PCT Application No. PCT/FR2020/050071, filed on Jan. 20, 2020, which claims priority to and the benefit of French Application No. 1900559 filed on Jan. 22, 2019, which are incorporated herein by reference in their entirety.

TECHNICAL FIELD

This invention relates to an article of clothing comprising at least two conductive wires configured to transmit an electrical signal and/or to heat said garment by the Joule effect. These two conductive wires are interconnected on the garment so as to create an electrical circuit.

The invention finds a particularly advantageous application in forming a new type of garment with a heating network incorporated into the garment or with an electrical circuit incorporated into the garment.

The practical applications of this invention are numerous and cover a large number of fields such as winter sports garments, garments incorporating light signals, rain garments, diving or surfing suits, garments intended for physiological analysis . . . .

For the purposes of the invention, an article of clothing corresponds to a piece intended to cover or be connected to a part of the body. Thus, an article of clothing refers to a jacket, pants, socks, shoes as well as a bag intended to be worn by a user.

PRIOR TECHNIQUES

Solutions for incorporating conductive wires into fabrics have long been sought.

For example, in the field of physiological analysis, document EP 0128103 describes the manufacture of a swimsuit incorporating physiological sensors. A network of conductive wires is attached to the swimsuit to transmit information from the physiological sensors to an analysis unit. The conductive wires are placed on the swimsuit and attached to it by non-conductive wires.

This method of attaching conductive wires is particularly difficult to achieve without damaging the conductive wires while ensuring an efficient attachment of the conductive wires to the garment.

In addition, this method of attachment generally degrades the aesthetic appearance of the garment because the conductive wire is an added element that is not incorporated into the structure of the garment.

In the field of garment ornamentation, metallic wires are used to form decorative patterns on the surface of a fabric. In the same way, these decorative metallic wires are attached by a seam attached to the metallic wires.

The production of antistatic clothing for evacuating electrostatic charges through a garment is also known. To do this, document JP 2009228161 proposes replacing the weft wires and the warp wires of a fabric with metallic wires so as to form a conductive network of electrostatic currents within the garment.

However, these metallic wires have a very small cross-section because they must be incorporated into the thickness of the fabric. Thus, these metallic wires can only conduct a few electrical charges, for example electrostatic charges, and they are not suitable for transmitting an electrical current.

In addition, there is a high risk of creating micro-cuts in the metallic wire when inserting the wire into the fabric or when using the garment.

To remedy this problem, the document JP 2009228161 uses a redundancy of a large number of wires.

Thus, the weft and warp structure of the conductive network is not adapted to create a localized and insulated electric circuit but to create a large contact surface allowing an electrostatic discharge.

In addition, it is also desirable to be able to form one or more interconnections on a garment between several conductive wires. As we know from document EP 1 506 738, this may be done by connecting bare conductive electric wires by tie points formed on the conductive wires or by pressing two conductive pellets together.

However, these types of interconnections do not make it possible to electrically connect conductive wires covered with insulating sheaths. Furthermore, when the garment is subjected to high stress, for example in the case of winter sports clothing, the conductive wires may move relative to each other which may cause the interconnection to break.

The technical problem of the invention is to obtain an article of clothing that incorporates an interconnection, between at least two conductive wires, which is resistant to the mechanical stresses undergone by the article of clothing, electrically insulated for the wearer of the article of clothing and relatively simple and quick to produce while limiting the risk of degradation of the article of clothing.

PRESENTATION OF THE INVENTION

To address this technical problem, the invention proposes to create a weld between two conductive wires, of which at least one conductive wire is incorporated within a flat seam. Before welding, a lower layer of fabric is bonded to the article of clothing to protect the article of clothing during the welding process. This lower layer of fabric also works together with an upper layer of fabric to protect the interconnection so as to electrically isolate the interconnection from the wearer of the garment and to protect the interconnection from mechanical stresses experienced by the garment.

To this end, according to a first aspect, the invention relates to an article of clothing comprising: at least two conductive wires adapted to transmit an electrical current, at least one conductive wire being embedded in at least one flat seam; and at least one electrical interconnection between said at least two conductive wires.

The invention is characterized in that said electrical interconnection incorporates a weld between said at least two conductive wires; and in that said electrical interconnection is protected by two layers of fabric respectively attached above and below said electrical interconnection: a lower layer of fabric bonded to said article of clothing over which said at least two conductive wires extend; and an upper layer of fabric bonded to said lower layer of fabric so as to form, with said lower layer of fabric, a protective barrier around said electrical interconnection.

The invention thus enables a strong interconnection to be formed by placing two layers of fabric above and below the interconnection.

In addition, the presence of the bottom layer of fabric makes it possible for a weld to form the interconnection because the bottom layer of fabric is able to protect the article of clothing from being over-heated or from possible tin spatter in the solder area.

In the sense of the invention, the term "bonding", used to describe the relationship between the lower layer of fabric and the article of clothing and/or the relationship between the upper layer of fabric and the lower layer of fabric, implies a multi-point bonding that may be achieved by gluing or hybridizing the two fabrics. Hybridization may be achieved by using layers of thermofusible fabric and bonding may be achieved by applying an adhesive patch.

Preferably, the bonding is achieved by an adhesive layer arranged under the layers of fabric. For example, this adhesive layer may be activated by heating the layer of fabric.

In addition, this multi-point connection may be configured to block, at least in part, the stretching capabilities of the article of clothing at the interconnection area. Alternatively, by using layers of fabric with flexible properties similar to the article of clothing, the article of clothing is able to retain these flexible properties at the interconnection area.

This multi-point link is intended to form a protective barrier around the electrical interconnection. Preferably, the layers of fabric are waterproof, and the multi-point bond is configured to form a waterproof protective barrier around the electrical interconnection.

To enhance the sealing and/or electrical resistance around the electrical interconnection, it is preferable to use an additional protective element placed over the electrical interconnection and between the lower and upper layers of fabric.

This additional protection may be a thermo-fusible sleeve or a piece of single or double-sided tape. The use of double-sided tape allows the position of the electrical interconnection to be fixed before the top layer of fabric is bonded to the bottom layer of fabric.

The mechanical strength of the electrical interconnection is also improved by the presence of the top and bottom layers of fabric. For this purpose, the layers of fabric are preferably between 0.1 and 1 mm thick, and even more preferably between 0.2 and 0.4 mm. In addition, the mechanical strength of the electrical interconnection may also be improved by twisting the conductive wires together at a position before or at the weld.

The invention may be implemented in a large number of variations. For example, the invention may be used to make an interconnection between two, three, four or five electrical wires. In fact, there is no limit to the number of electrical wires that may be interconnected with the protective barrier provided by the invention's layers of fabric.

In the sense of the invention, at least one conductive wire is incorporated into a flat seam. The other wires of the interconnection may also be incorporated into the same or another flat seam or may correspond to free wires, i.e., wires that are not bonded to the article of clothing.

The flat seam may extend above or below the bottom layer of fabric. When the flat seam extends below the bottom layer of fabric, this bottom layer of fabric has an opening through which the conductive wires emerge.

According to one embodiment, said at least one flat seam comprises: at least two substantially parallel border wires; and at least one bonding wire placed flatly and sinuously between said border wires; said bonding wires having curvatures connected alternately to said border wires; said bonding wire corresponding to said at least one metallic wire.

Indeed, the bonding wire of a flat seam is particularly suitable for the placement of a conductive wire because this bonding wire is laid flat with a sinusoidal shape, the curvatures of which are large enough to limit the mechanical stresses on the conductive wire.

A flat seam is also called "cover stitch seam" and "Flat Lock", "Covering Chain Stitches" or "Over Lock" in the English literature. It is defined by class 600 of the Afnor ISO 4915 standard.

A flat seam is generally used to join pieces of fabric edge to edge without creating an overlap, thus allowing great flexibility of the fabrics relative to each other or for decorative purposes.

To do this, this flat seam incorporates a first border wire sewn on a first fabric and a second border wire sewn onto a second fabric. A bonding wire is laid out flat with a sinusoidal shape at the junction between the two fabrics. The border wires pass over the local ends of the bonding wire so as to bond each side of the bonding wire to a separate fabric.

As a result, this flat seam has great flexibility and is particularly suitable for joining stretch fabrics. Thus, a flat seam which has at least one conductive wire in place of the connective bonding wire between two border wires makes it possible to integrate at least one conductive wire into an article of clothing without degrading the aesthetics of the garment because at least one conductive wire is contained in the seam.

In addition, the use of at least one conductive wire in the flat seam allows the use of at least one conductive wire with a cross section sufficient to carry electrical charges supporting a large power range and which can be swaddled/insulated to protect the wearer of the garment against possible short-circuit.

The use of an insulated wire also makes it possible to cross several wires without risking a short-circuit. The risks of micro-cuts are also reduced because the conductive wires have a large degree of freedom in the event of deformation of the flat seam due to the shape of the flat seam.

Within the sense of the invention, an article of clothing corresponds to a finished or semi-finished item making it possible to form a garment or a garment in its entirety. This article of clothing may be made from all known materials: weft and warp, knits, non-woven . . . .

Thus, the flat seam of the invention may be placed in the center of a piece of fabric forming a garment, for example to produce a decorative pattern in addition to transporting electrical power. The flat seam of the invention may also make assembling different constituent panels of the garment possible.

The flat seam incorporating at least one conductive wire makes it possible to create a conductive electrical network on a garment in order to transmit an electrical signal and/or to heat the garment by the Joule effect. In addition, electrical wires may be insulated to protect the wearer of the garment.

According to one embodiment, said flat seam incorporates at least one other bonding wire extending in a different plane from said flat bonding wire. This embodiment makes it possible to incorporate at least one conductive wire in a flat seam incorporating 4 wires, 5 wires, or more.

According to one embodiment, said flat seam incorporates at least two conductive wires, the conductivity and/or resistivity of which is identical or different. This embodiment makes it possible to produce at least one flat seam with modulated resistivity.

By modulating the resistivity of the flat seam, it is possible to locate areas of heating on a garment by allowing the same seam to transmit heating power and to warm the wearer of the garment.

According to one embodiment, said at least one other bonding wire corresponds to a metallic wire. This embodiment makes it possible to produce at least a portion of a flat seam with a different resistivity from another part of a flat seam in which the other bonding wire is not conductive. By modulating the resistivity of the flat seam, it is possible to locate heating zones on a garment by allowing a portion of a seam to transmit heating power and another part to warm the wearer of the garment, in particular by making seam interconnections using wires of different resistivities.

According to one embodiment, at least one border wire corresponds to a metallic wire. This embodiment makes it possible to modulate even more the resistivity of a portion of a flat seam by increasing the number of conductive elements.

According to one embodiment, said article of clothing comprises at least one connector electrically linked to said at least one conductive wire so as to electrically connect said flat seam with an external device.

This embodiment allows the flat seam to be connected with an external device, for example a power supply.

According to one embodiment, said article of clothing comprises at least one sensor electrically connected to said at least one conductive wire. This embodiment allows the flat seam to carry information from a sensor, for example, a sensor placed in contact with the skin of the wearer of the garment.

According to one embodiment, said article of clothing comprises at least one electrical energy consumer unit electrically connected to said at least one conductive wire. This embodiment allows the flat seam to carry electrical energy to power an energy consumer unit, for example to light an LED.

As regards the simplicity and speed of the method for producing the interconnection, they depend on the method used by the many possible variants.

For example, according to a second aspect, the invention relates to a method of interconnection between at least two conductive wires, said method comprising the following steps:

bonding of a lower layer of fabric to an article of clothing;
making at least one flat seam incorporating at least one conductive wire suitable for transmitting an electric current;
producing a weld between at least two conductive wires, at least one conductive wire which is incorporated into said at least one flat seam; and
bonding an upper layer of fabric to said lower layer of fabric so as to incorporate said weld between said lower layer of fabric and said upper layer of fabric.

The conductive wires may be soldered directly at the level of the lower layer of fabric by means of a gripper and a soldering iron as long as the lower layer of fabric sufficiently absorbs the heating generated by the solder to protect the article of clothing.

As a variant, the weld may be performed at a distance greater than 1 cm from the article of clothing. To do this, the method also comprises a step to extract at least one conductive wire from said at least one flat seam.

According to another variant, described in a third aspect, the invention relates to a method of interconnection between at least two conductive wires, said method comprising the following steps:

production, in an interconnection zone, of at least one flat seam incorporating at least one conductive wire suitable for transmitting an electric current;
extracting at least one conductive wire from said at least one flat seam;
bonding a lower layer of fabric to said interconnection zone; said lower layer of fabric having an opening through which at least two conductive wires are passed before bonding said lower layer of fabric;
producing a weld between said at least two conductive wires, at least one conductive wire which is incorporated into said at least one flat seam;
and bonding an upper layer of fabric to said lower layer of fabric so as to incorporate said weld between said lower layer of fabric and said upper layer of fabric.

For the second or third aspect of the invention, the method may or may not include a step of applying an additional protective element to the weld before bonding the upper fabric.

BRIEF DESCRIPTION OF FIGURES

The manner of carrying out the invention, as well as the advantages which result therefrom, will emerge clearly from the description of the embodiments which follow, in support of the appended figures wherein.

Of course, the dimensions and proportions of certain constituent elements of the invention may have been distorted, exaggerated and deviated from reality, for the purpose of making the invention clearly understood. Furthermore, the description uses the terms "upper" and "lower" to simply describe the different layers forming the protective barrier of the interconnection. These relative terms refer to a vision of an interconnection with the article of clothing as a basic element.

Of course, the garment may be worn in different positions and the "lower" and "upper" layers may be inversely positioned relative to the floor.

MANNER OF CARRYING OUT THE INVENTION

Figure 1:
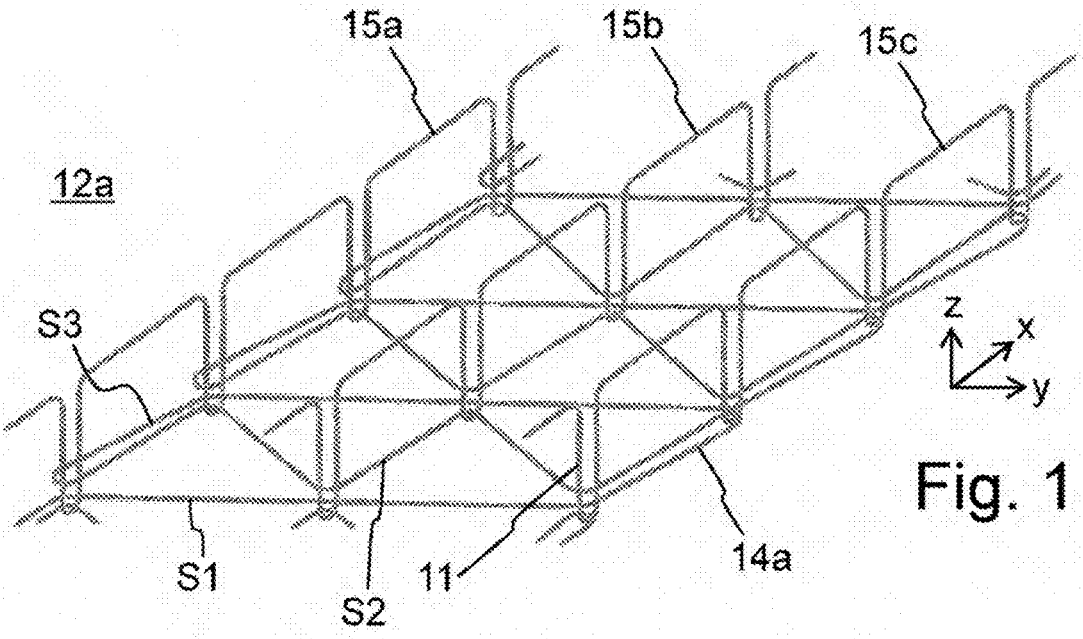
FIG. 1 is a schematic representation in perspective of a flat seam according to a first embodiment of the invention.
Figure 2:
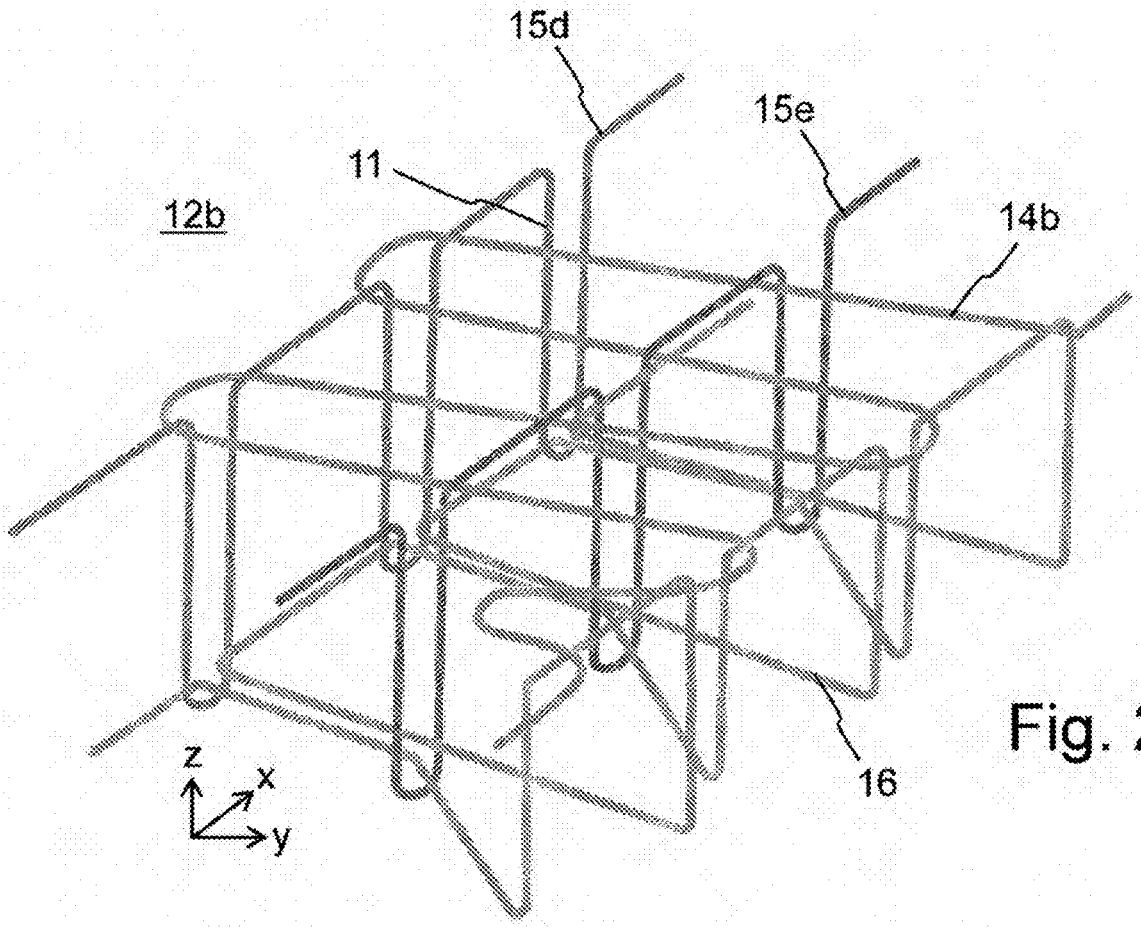
FIG. 2 is a schematic representation in perspective of a flat seam according to a second embodiment of the invention.

FIGS. 1 and 2 show two embodiments of a flat seam 12*a*, 12*b* incorporating a conductive wire 14*a*, 14*b*. The first flat seam 12*a*, illustrated in FIG. 1, comprises four wires: three border wires 15*a*-15*c* and a bonding wire 14*a*. Each border wire 15*a*-15*c* extends in a weft x direction with stitches 11 forming loops in the mesh of the fabric to which the border wire 15*a*-15*c* is sewn.

From each stitch 11, the border wire 15*a*-15*c* extends into the fabric in a direction z, orthogonal to the weft x and warp y direction of the fabric. The three border wires 15*a*-15*c* are sewn substantially parallel to the fabric or to several fabrics placed edge to edge so as to form an article of clothing. The connection between these border wires 15*a*-15*c* is secured by a bonding wire 14*a* extending in the weft x and warp y direction of fabric at the lower ends of the stitches 11. Thus, the article of clothing has an upper surface at the level of which the three border wires 15*a*-15*c* are visible and a lower surface at the level of which the bonding wire 14*a* is visible.

The bonding wire 14*a* has a first section S1, substantially straight, passing through each loop of the stitching 11 of the three border wires 15*a*-15*c*. A second S-shaped section S2 extends between two consecutive loops of stitches 11 of a first border wire 15*a*-15*c* and extends at an angle between two loops of two separate border wires 15*a*-15*c*. A last section S3 forms a opening around the first stitch 11 until a new weft of the flat seam 12*a* is achieved.

This seam pattern is known in the English literature under the term triple wire "Flat Lock", with reference to the three border wires 15*a*-15*c*.

The bonding wire 14*a* is produced by a conductive wire. For example, the conductive wire 14*a* may correspond to a circular section of copper wire with a diameter of 2 mm. Preferably, the diameter of the conductive wire 14*a* is less than 2 mm. Even more preferably, the diameter of the conductive wire 14*a* is less than 1 mm. Of course, the conductive wire 14*a* may be made with another conductive material without changing the invention. For example, with a material or an alloy having an electrical conductivity greater than $1.10^6$ $S \cdot m^{-1}$. In addition, the conductive wire 14*a* may be covered with a shield and/or a sheath.

The flat seam may also have other topologies. For example, in the case of FIG. 1, only two border wires 15*a* and 15*c* may be used.

FIG. 2 illustrates a second example of a flat seam 12*b* corresponding to the invention. This flat seam 12*b* incorporates two border wires 15*d*-15*e* and two bonding wires 14*b* and 16. As described above, each border wire 15*d*-15*e* extends in a weft x direction with stitches 11 forming loops in the mesh of the fabric to which the border wire 15*d*-15*e* is sewn. From each stitch 11, the border wire 15*d*-15*e* extends into the fabric in a direction z, orthogonal to the weft x and warp y direction of the fabric.

The bond between these border wires 15*d*-15*e* is provided by two bonding wires 14*b* and 16. A bonding wire 16 extends along three directions x, y and z of the fabric and a bonding wire 14*b* extends only along the weft x and warp y directions of the fabric. This seam pattern is known in the English literature under the term four-wire "over lock", with reference to the four wires forming the flat seam 12*b*.

The bonding wire 14*b* is placed flat on the fabric with loops interposed between the stitches 11 and the loops of the bonding wire 16.

Thus, as described with reference to FIG. 1, this bonding wire 14*b* may be produced by a conductive wire. These flat seams 12*a*-12*b* may be used for different applications without changing the invention.

For example, they can make it possible to carry out topstitching, decorative patterns on a fabric, or the assembly of two fabrics, in a secure manner or not. The nature of the fabric is also irrelevant. For example, the flat seams 12*a*-12*b* may be adapted to secure stretch or ultra-stretch fabrics.

This conductive wire 14*a*-14*b*, integrated in a flat seam 12*a*-12*b*, makes it possible to transmit electrical power in the flat seam 12*a*-12*b*. By using a single flat seam 12*a*-12*b* that incorporates a conductive wire 14*a*-14*b*, it is possible to heat a portion of a garment upon which the flat seam 14*a*-14*b* is formed. In addition, a flat seam 12*a*-12*b* may incorporate other metallic wires in addition to the conductive wire 14*a*-14*b*.

In the example of FIG. 2, the bonding wire 16 may correspond to a metallic wire with one section smaller than the conductive wire 14*a*-14*b* so as to resist the multiple curvatures induced by the topology of the flat seam 12*b*. For example, the bonding wire 16 may correspond to a circular section of copper wire with a diameter of 0.5 mm.

Likewise, at least one border wire 15*a*-15*e* may correspond to a metallic wire. Furthermore, the metallic wires, other than the conductive wire 14*a*-14*b*, may be incorporated to only a portion of the flat seam 12*a*-12*b* so that the resistance of the flat seam 12*a*-12*b* varies depending on the number of conductive elements.

An article of clothing 10 may have several flat seams 12*a*-12*b* forming a conductive network.

To do this, electrical interconnections must be formed between several conductive wires 14*a*-14*c*, whether or not they are incorporated into a flat seam 12*a*-12*b*.

Figure 3:
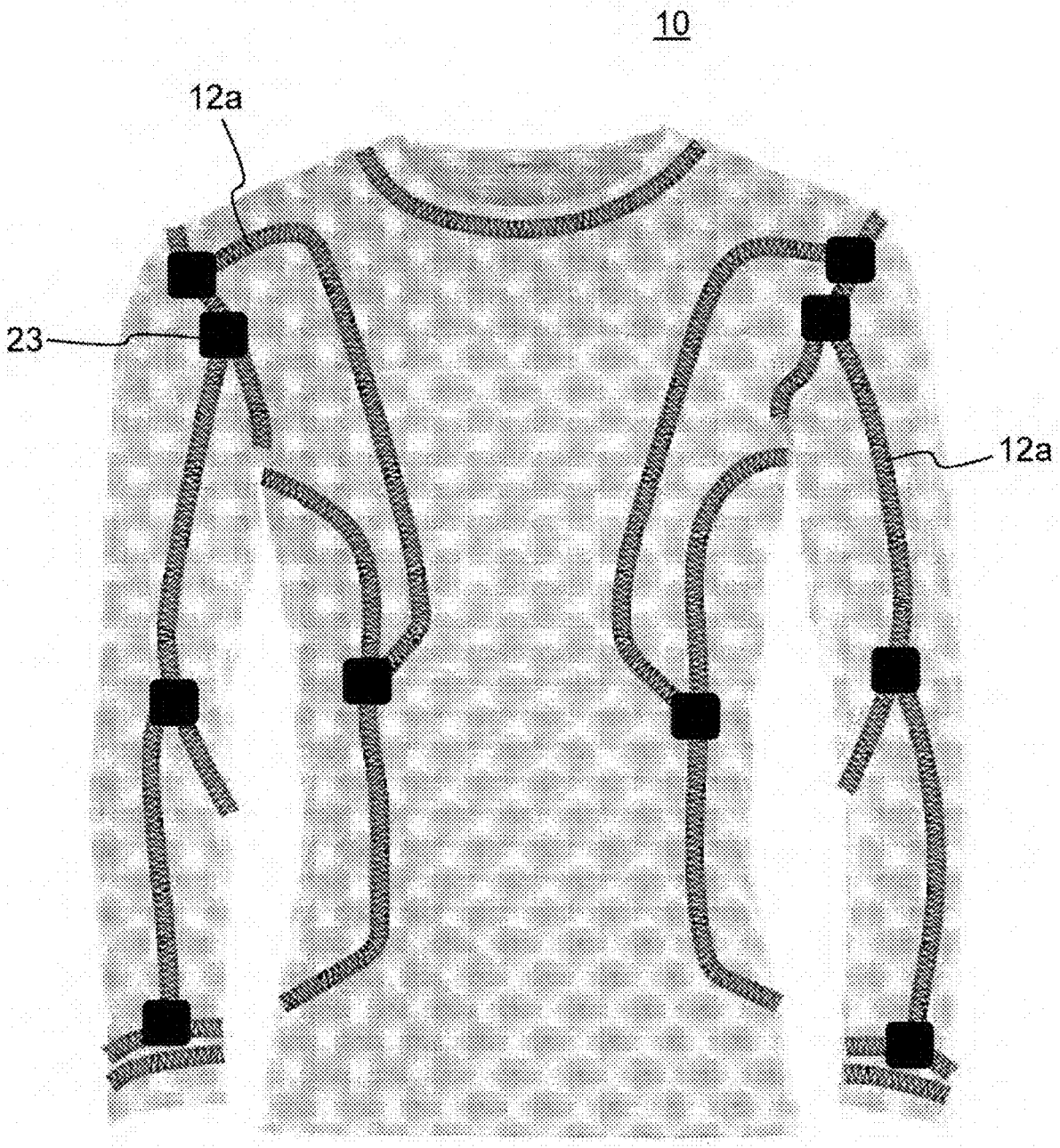
FIG. 3 is a front view of a garment incorporating a conductive network formed by a set of flat seams according to the embodiment of FIG. 1.

The invention proposes a solution for making an electrical interconnection between at least two conductive wires 14*a*-14*c*, of which at least one conductive wire 14*a*-14*b* is incorporated into a flat seam 12*a*-12*b*, for example, as described above. Thus, as illustrated in FIG. 3, the invention makes it possible to obtain a garment 10 incorporating several flat seams 12*a*-12*b* and forming a conductive network. More particularly, the invention proposes creating an electrical interconnection by means of a weld 25 between at least two conductive wires 14*a*-14*c*. The protection of the weld 25 is provided by two layers of fabric: a lower layer of fabric 21-22, and an upper layer of fabric 23. These layers of fabric form a protective barrier at the electrical interconnection and around the weld 25.

In addition, the weld 25 may also be protected by an additional protective element 27, such as a heat-shrinkable sleeve or a single or double-sided tape.

There are many variants of the invention but, in all cases, a lower layer of fabric 21-22 is bonded to the article of clothing 10 before the production of the weld 25 so that this lower layer of fabric 21-22 protects the article of clothing 10 during welding. In addition, an upper layer of fabric 23 is always bonded onto the lower layer of fabric 21 to 22 to form the barrier around the electrical interconnection.

The bottom layers of fabric 21-22 and upper layer 23 may include an upper layer ensuring the mechanical strength of the fabrics 21-23 and an adhesive bottom layer intended to produce a thermal adhesive to bond the layers of fabric 21-23.

Preferably the layers of fabric 21-23 have a thickness between 0.1 and 1 mm, and preferably between 0.2 and 0.4 mm.

For example, layers of fabric 21-23 may be made of a polyester/polyurethane adhesive complex with a total thickness of 0.31 mm and an activation temperature above 60° C. The technical characteristics of layers of fabric 21-23 are preferentially sought to adapt to the technical characteristics of the article of clothing 10.

For example, the technical characteristics of layers of fabric 21-23 may be sought with elastic properties similar to the article of clothing 10 so as to obtain a flexible electrical interconnection in the same way as the article of clothing 10. On the contrary, more rigid layers of fabric 21-23 may be sought in order to block the movements of the piece of clothing 10 in the interconnection zone and to limit the mechanical stresses undergone by the conductive wires 14*a*-14*b* in this zone.

The lower layer of fabric 21-22 may take various forms without changing the invention. For example, the lower layer of fabric 21-22 may correspond to a tape or a disc. In addition, this lower layer of fabric 21 may include an opening 24 through which the conductive wires 14*a*-14*b* are passed before performing the weld 25. Thus, it is possible to place the lower layer of fabric 21 after making at least one flat seam 12*a*-12*b* by passing the conductive wires through the opening 24.

FIGS. 4 to 7 illustrate four distinct embodiments making it possible to connect from 2 to 4 conductive wires 14*a*.

Figure 6:
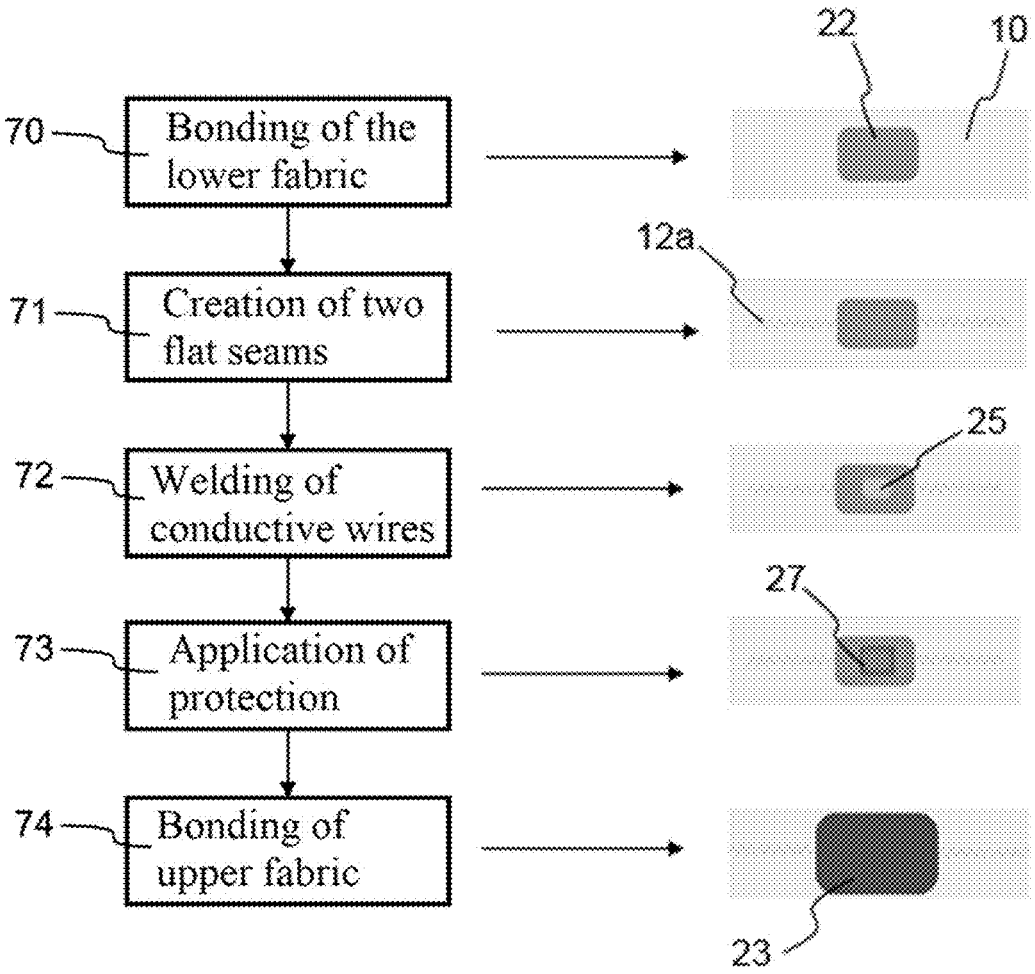
FIG. 6 is a flowchart illustrating the steps for carrying out a method of interconnection according to a third embodiment of the invention, certain steps being illustrated by top views of the progress of the method.

In the example of FIG. 6, two conductive wires 14*a* incorporated into two flat seams 12*a* are welded together.

Figure 4:
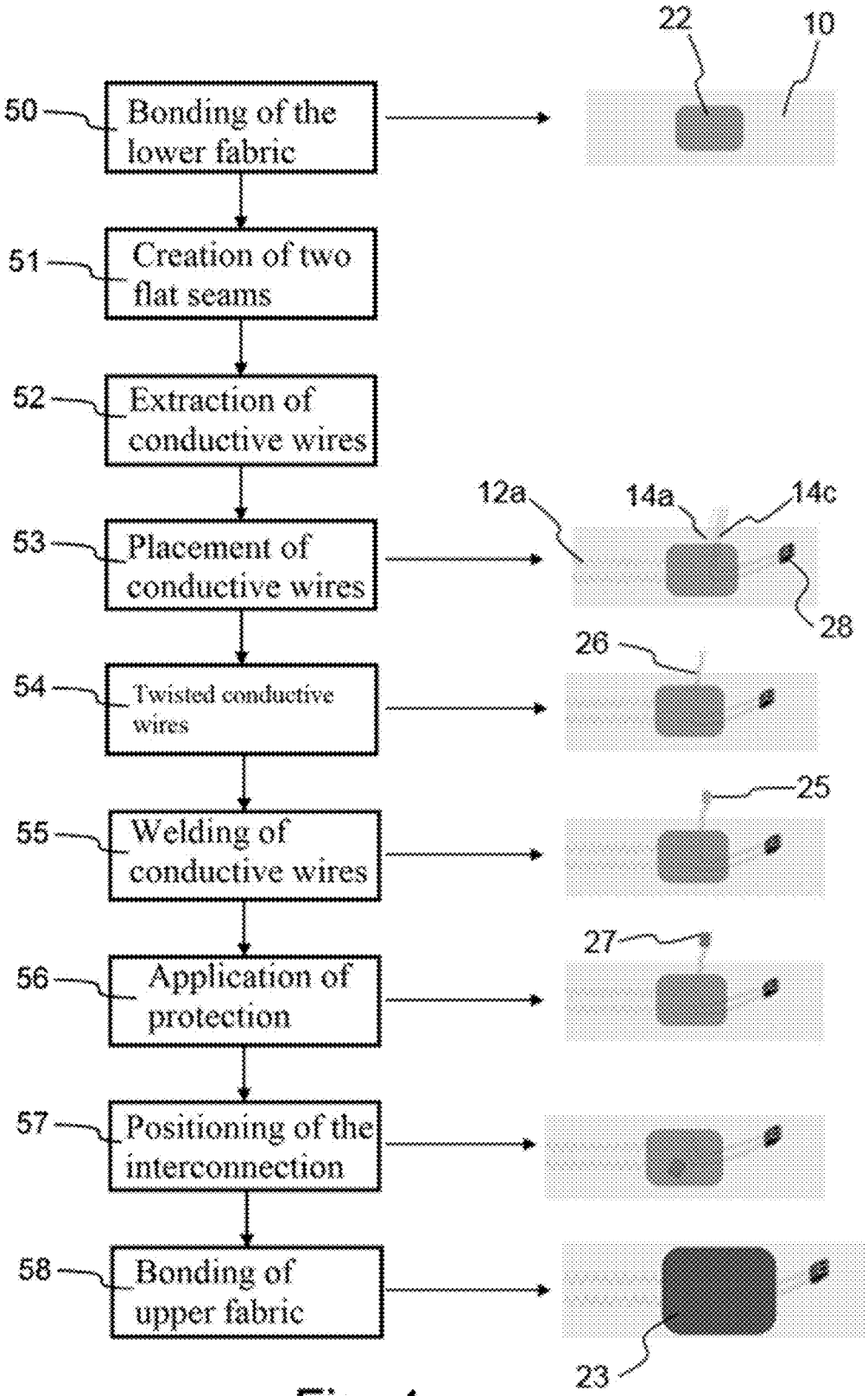
FIG. 4 is a flowchart illustrating the steps for carrying out a method of interconnection according to a first embodiment of the invention, certain steps being illustrated by top views of the progress of the method.
Figure 5:
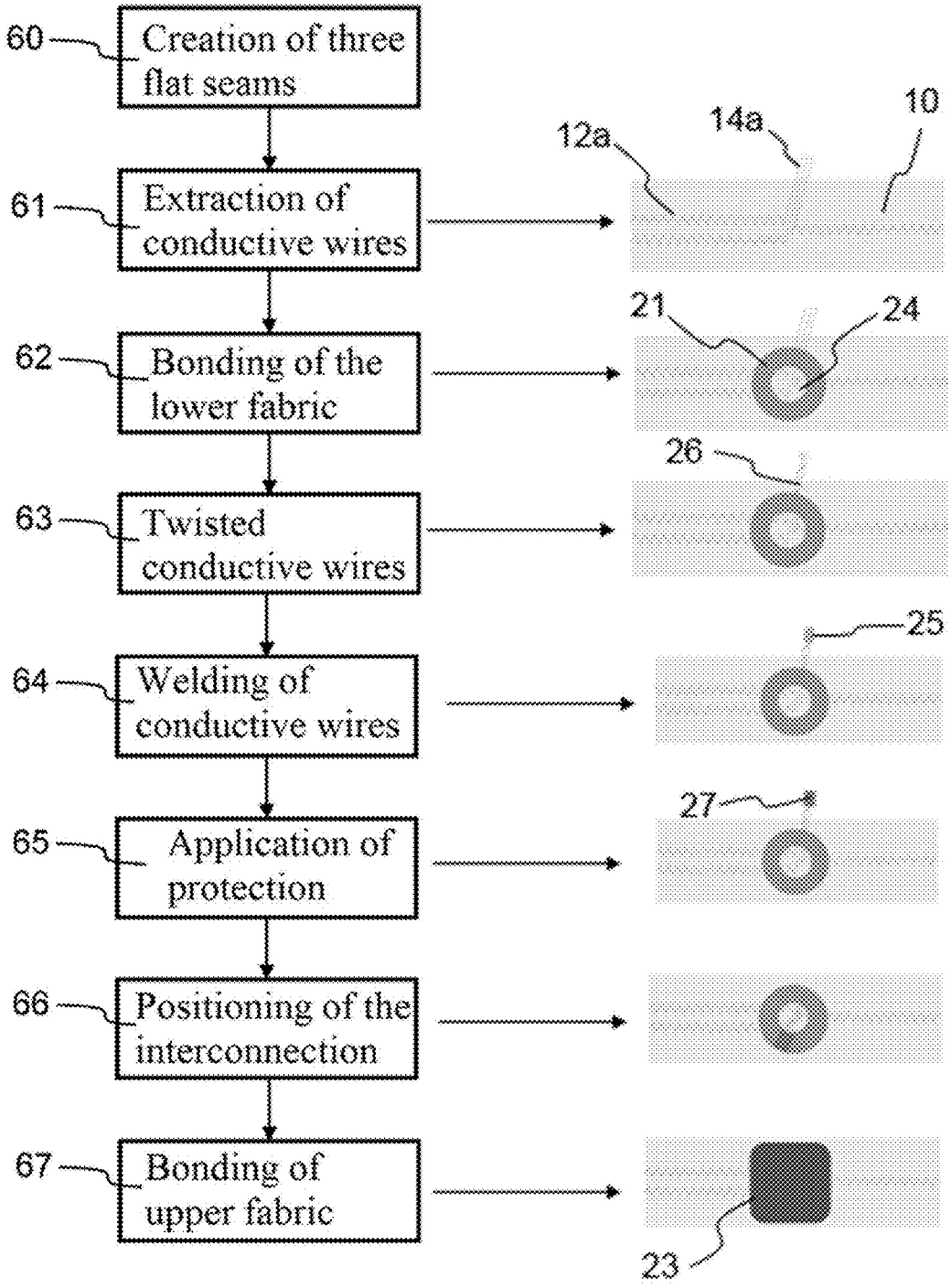
FIG. 5 is a flowchart illustrating the steps for carrying out a method of interconnection according to a second embodiment of the invention, certain steps being illustrated by top views of the progress of the method.
Figure 7:
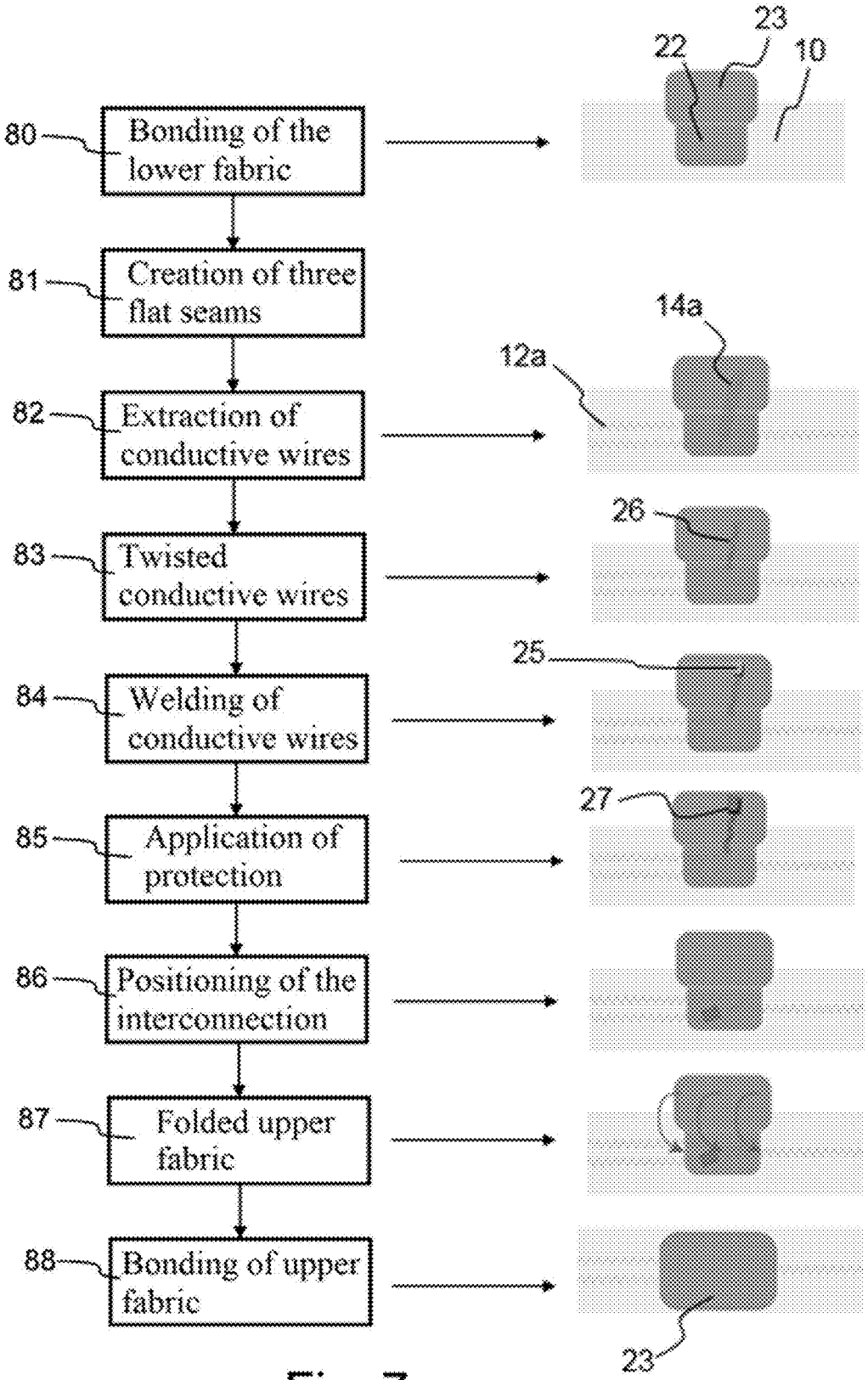
FIG. 7 is a flowchart illustrating the steps for carrying out a method of interconnection according to a fourth embodiment of the invention, certain steps being illustrated by top views of the progress of the method.

In the example of FIGS. 5 and 7, three conductive wires 14*a* incorporated into three flat seams 12*a* are welded together. In the example of FIG. 4, two conductive wires 14*a* incorporated into two flat seams 12*a* are welded together with two free conductive wires 14*c*. These conductive wires 14*c* are not attached to the article of clothing 10 and are only bonded with a connector 28 external to the article of clothing 10. 14*a* of one or more flat seams 12*a* or at least one conductive wire 14*a* incorporated into a flat seam 12*a* with at least one free conductive wire 14*c*.

In the example of FIG. 4, a first step 50 consists in bonding a lower layer of fabric 22 to an article of clothing 10. Two flat seams 12*a* are then made, in a step 51, on the article of clothing 10 until reaching and partially covering the lower layer of fabric 22. Thus, the two flat seams 12*a* end on the lower layer of fabric 22. Alternatively, the flat seams 12*a* may continue after passing over the lower layer of fabric 22.

A step 52 then consists of extracting the conductive wires 14*a* from the flat seams 12*a* by pulling the conductive wires 14*a* in order to position them at a distance of approximately 2 cm from the article of clothing 10. A step 53 consists in positioning the free conductive wires 14*c*. The four conductive wires 14*a*-14*c* intended to be soldered are then twisted together, in a step 54, so as to form a twist 26 going from the lower layer of fabric 22 to the upper end of the conductive wires 14*a*-14*c*. The weld 25 can thus be carried out at the end of the conductive wires 14*a*-14*c* since the twist 26 provides a certain resistance and a certain fixing of the conductive wires 14*a*-14*c* with respect to one another. This weld 25 is carried out, in a step 55, with conventional means, such as a soldering iron and a tin coil.

It is possible that this weld 25 is sufficient to produce the electrical interconnection. As a variant, it may be preferable to add a protective element 27 located on this weld 25, such as a piece of single or double-sided tape or a heat-shrinkable sleeve. The application of a double-sided tape in a step 56 makes it possible to facilitate the next step 57 of positioning the weld 25 in the electrical interconnection, that is to say, in the zone delimited by the lower layer of fabric 22. When the solder 25 is correctly placed on the lower layer of fabric 22 and the conductive wires 14*a*-14*c* are all placed in this zone, a step 58 consists in bonding an upper layer of fabric 23 upon the lower layer of fabric 22. Bonding of the lower 22 and upper 23 layers of fabric is preferably carried out by thermo-welding using a soldering iron applied to the layers of fabric 22.

The method illustrated in FIG. 5 differs from the method of FIG. 4 in that the lower layer of fabric 21 has an opening 24. Thus, a first step 60 consists in directly making three flat seams 12*a* on an article of clothing 10. The conductive wires 14*a* are then extracted from these flat seams 12*a* in a step 61. It is only after the extraction of the conductive wires 14*a*, that the lower layer of fabric 21 is bonded to the article of clothing 10, in a step 62, by passing the conductive wires 14*a* through the opening 24 and by bonding the edges of the lower layer of fabric 21 around and above the flat seams 12*a*. Thus, the lower layer of fabric 21 maintains the flat seams 12*a* at the base of the conductive wires 14*a* extracted from the flat seams 12*a*.

The method then continues, in a step 63, by twisting the conductive wires 14*a* and then by applying, in a step 64, a weld 25 upon the conductive wires 14*a*. Protection 27 is then applied, in a step 65, and then this protection 27 and this weld 25 are positioned, in a step 66, on the lower layer of fabric 21.

The last step 76 consists, once again, in bonding an upper layer of fabric 23 onto the lower layer of fabric 21.

As illustrated in FIGS. 4 to 7, the upper layer of fabric 23 will preferably have a surface that is more elevated than the surface of the lower layer of fabric 21 so as to easily encompass this lower layer of fabric 21.

The process of FIG. 6 is faster to carry out because it proposes to solder the conductive wires directly at the level of the lower layer of fabric 22. To do this, a first step 70 consists of bonding the lower layer of fabric 22 onto the article of clothing 10 and a second step 71 consists of making two overlapping flat seams 12*a* in the area of the lower layer of fabric 22.

In step 72, welding 25 of the conductive wires 14*a* of the two flat seams 12*a* is then carried out by means of a clamp that slightly raises the conductive wires 14*a* of the flat seams 12*a* so that a soldering iron may apply a weld a few millimeters above the lower layer of fabric 22. Alternatively, the weld 25 may be performed without lifting the conductive wires 14*a* by using a rectangular soldering iron to buffer the conductive wires 14*a*. In addition, if the soldering iron is previously bathed in a thin layer of tin, it is possible to carry out automated soldering.

In the embodiment of FIG. 6, the lower layer of fabric 22 must have increased thermal resistance so as to limit the thermal stresses to which the article of clothing 10 is subjected.

Optionally, the method may continue, in a step 73, by the application of a protection element 27 while maintaining the elevation of the conductive wires by using the clamp and by positioning the protection element 27 on either side of the suture 25 previously made.

In all cases, the method ends with a step 74 consisting of bonding an upper layer of fabric 23 to the lower layer of fabric 22.

In the embodiments of FIGS. 4 to 6, the lower layers of fabric 21 to 22 and upper layer 23 are described, but these layers of fabric correspond to separate elements from each other.

In the embodiment of FIG. 7, the bottom layers of fabric 21 to 22 and top 23 are formed in a single piece of fabric having a predetermined fold line so that the upper layer of fabric 23 covers the lower layer of fabric 22 so as to create the bond of the upper layer of fabric 23 to the lower layer of fabric 22.

Thus, the method of FIG. 7 comprises a first step 80 consisting of securing the portion of the piece of fabric ensuring the role of lower layer of fabric 22. This portion of the piece of fabric has a smaller surface area than the portion of the piece of fabric ensuring the role of the upper layer of fabric 23.

To ensure that the lower layer of fabric 22 is bonded, the lower part of the piece of fabric may be provided with an adhesive lower layer placed only on this part.

In a step 81, three flat seams 12*a* are then made on the article of clothing 10 to end on the piece of fabric at the level of the lower layer of fabric 22. In a step 82, the conductive wires 14*a* of these three flat seams 12*a* are then extracted so that they extend to a distance from the article of clothing 10 sufficient to facilitate performing the weld 25.

The conductive wires 14*a* are twisted, in a step 83, then soldering 25 is carried out, in a step 84.

Step 85 then proposes the application of a protective element 27 and all of this interconnection is then positioned, in a step 86, on the lower layer of fabric 22.

Step 87 consists in folding the piece of fabric along the predetermined fold line so that the portion of the piece of fabric forming the upper layer of fabric 23 is found above the portion of the piece of fabric forming the lower layer of fabric 22. In this step, an external adhesive may be positioned on the lower layer of fabric 22 to ensure the bonding of the upper layer of fabric 23 to the lower layer of fabric 22.

Thus, the last step 88 makes bonding of the upper layer of fabric 23 to the lower layer of fabric 22 possible, for example by applying pressure upon this upper layer of fabric 23.

The invention makes it possible to obtain an interconnection, between at least two conductive wires 14*a*-14*b*, which is resistant to the stresses undergone by the article of clothing 10, electrically insulated for the wearer of the article of clothing 10 and relatively simple and quick to use while limiting the risk of the degradation of the article of clothing 10.

The invention thus makes it possible to produce a new type of garment 10 comprising conductive wires 14*a*-14*b* integrated into flat seams 12*a*-12*b* and interconnected with each another or with external wires. This new type of clothing may be used to make winter sports clothing, clothing incorporating light signals, or clothing intended for physiological analysis.

The invention claimed is:

1. An article of clothing comprising:

at least two conductive wires adapted to transmit an electric current, said at least two conductive wires being incorporated into at least two flat seams; and at least one electrical interconnection between said at least two conductive wires;

characterized in that said electrical interconnection incorporates a weld between said at least two conductive wires; and in that said electrical interconnection is protected by two layers of fabric respectively attached above and below said electrical interconnection:

a lower layer of fabric bonded to said article of clothing over which said at least two conductive wires extend; and an upper layer of fabric secured to said lower layer of fabric so as to form, with said lower layer of fabric, a protective barrier around said electrical interconnection.

2. The article of clothing according to claim 1, wherein said lower layer of fabric, or said upper layer of fabric, has an adhesive lower layer.

3. The article of clothing according to claim 1, wherein said electrical interconnection is also protected by an additional protective element placed upon said electrical interconnection and between said lower and upper layers of fabric.

4. The article of clothing according to claim 1, wherein said electrical interconnection also incorporates a twist between said at least two conductive wires.

5. The article of clothing according to claim 1, wherein said at least two conductive wires correspond to said at least one free conductive wire soldered to said at least one conductive wire integrated in at least two flat seams.

6. The article of clothing according to claim 1, wherein said at least one flat seam extends over said lower layer of fabric.

7. The article of clothing according to claim 1, wherein said at least one flat seam extends over said lower layer of fabric; said lower layer of fabric comprising an opening through which said at least two conductive wires emerge.

8. The article of clothing according to claim 1, wherein said lower layer of fabric, or said upper layer of fabric, has a thickness between 0.1 and 1 mm.

9. The article of clothing according to claim 1, wherein said at least one flat seam comprises:

at least two border wires, substantially parallel; and at least one bonding wire placed flat and sinuously between said edge wires; said bonding wire having curves connected alternately to said edge wires; said bonding wire corresponding to said at least one metallic wire.

10. The article of clothing according to claim 1, wherein said lower layer of fabric, or said upper layer of fabric, has a thickness between 0.2 and 0.4 mm.

* * * * *